US006729243B2

(12) United States Patent
Annas

(10) Patent No.: US 6,729,243 B2
(45) Date of Patent: May 4, 2004

(54) TABLE WITH SELF-STORING LEAF

(75) Inventor: Timothy L. Annas, Newton, NC (US)

(73) Assignee: La-Z-Boy Incorporated, Monroe, MI (US)

( * ) Notice: Subject to any disclaimer, the term of this patent is extended or adjusted under 35 U.S.C. 154(b) by 21 days.

(21) Appl. No.: 10/123,862

(22) Filed: Apr. 16, 2002

(65) Prior Publication Data

US 2003/0192459 A1 Oct. 16, 2003

(51) Int. Cl.[7] ..... A47B 1/04
(52) U.S. Cl. ..... 108/86; 108/89
(58) Field of Search ..... 108/83, 84, 85, 108/86, 89, 65

(56) References Cited

U.S. PATENT DOCUMENTS

| | | | | | |
|---|---|---|---|---|---|
| 152,196 | A | * | 6/1874 | Valentin | 108/84 |
| 905,342 | A | * | 12/1908 | Hohr et al. | 108/84 |
| 998,110 | A | * | 7/1911 | Mosch | 108/84 |
| 2,205,274 | A | * | 6/1940 | Charne et al. | 108/67 |
| 3,294,042 | A | * | 12/1966 | Rastetter | 108/84 |
| 4,475,464 | A | | 10/1984 | Deconinck | |
| 5,203,266 | A | | 4/1993 | Stevens | |
| 5,927,212 | A | | 7/1999 | Huang | |

FOREIGN PATENT DOCUMENTS

| | | | | |
|---|---|---|---|---|
| CA | 505806 | * | 9/1954 | 108/86 |

* cited by examiner

*Primary Examiner*—Lanna Mai
(74) *Attorney, Agent, or Firm*—Harness, Dickey & Pierce, P.L.C.

(57) ABSTRACT

An extendable table having a stowable leaf member. The table includes a first table section having a first table surface and a second table section having a second table surface. The second table section is movably coupled to the first table section in a coplanar relationship. A leaf member is further provided and is selectively positionable in an operable position between the first table surface and the second table surface and a stowed position below the table surface. A pivoting assembly couples the leaf member to the first and second table sections and permits the leaf member to rotate about a generally vertical axis and a generally horizontal axis between an operable position and a stowed position. When in this stowed position, the leaf member is generally nestled along the underside of the extendable table out of sight of a guest.

20 Claims, 4 Drawing Sheets

FIG 3
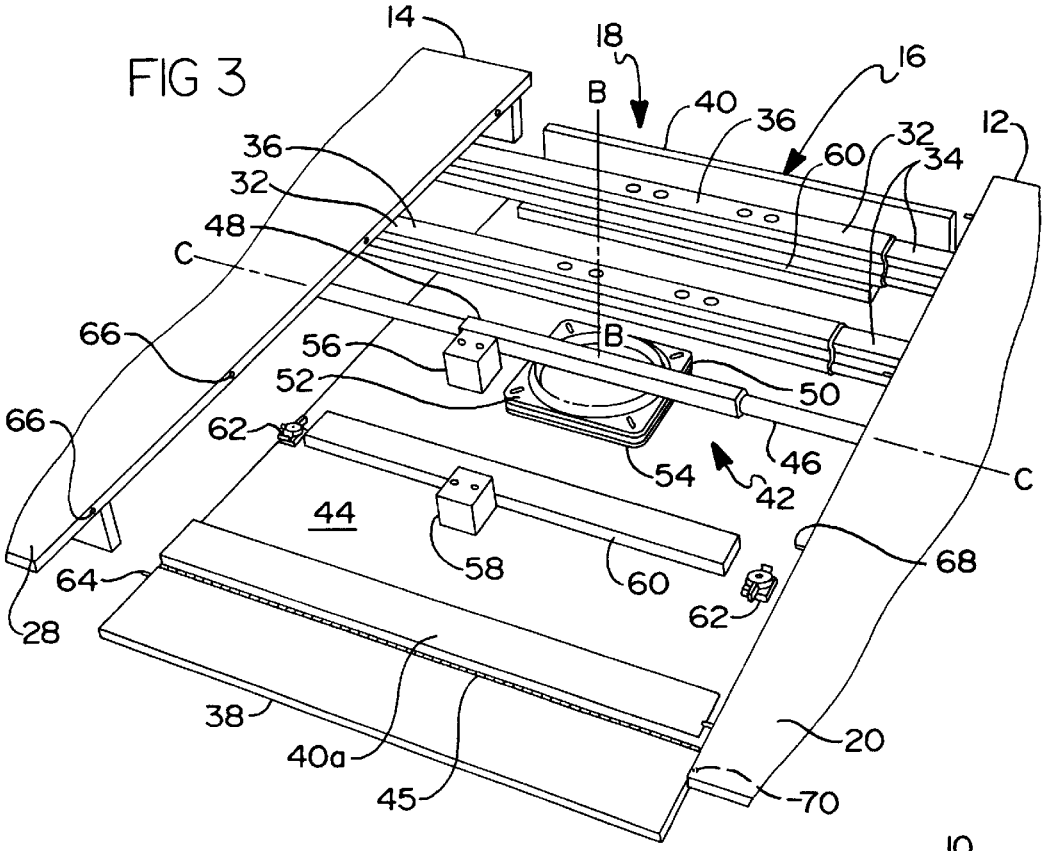
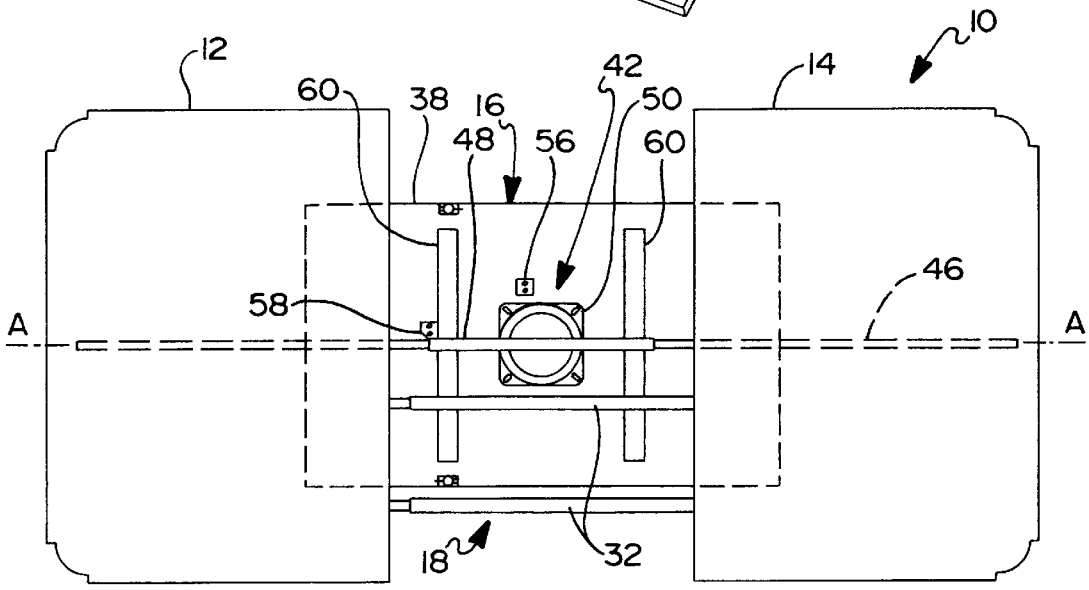
FIG 4

FIG 6
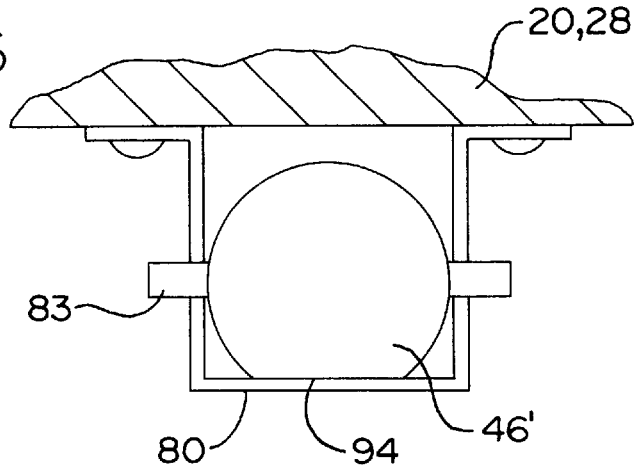
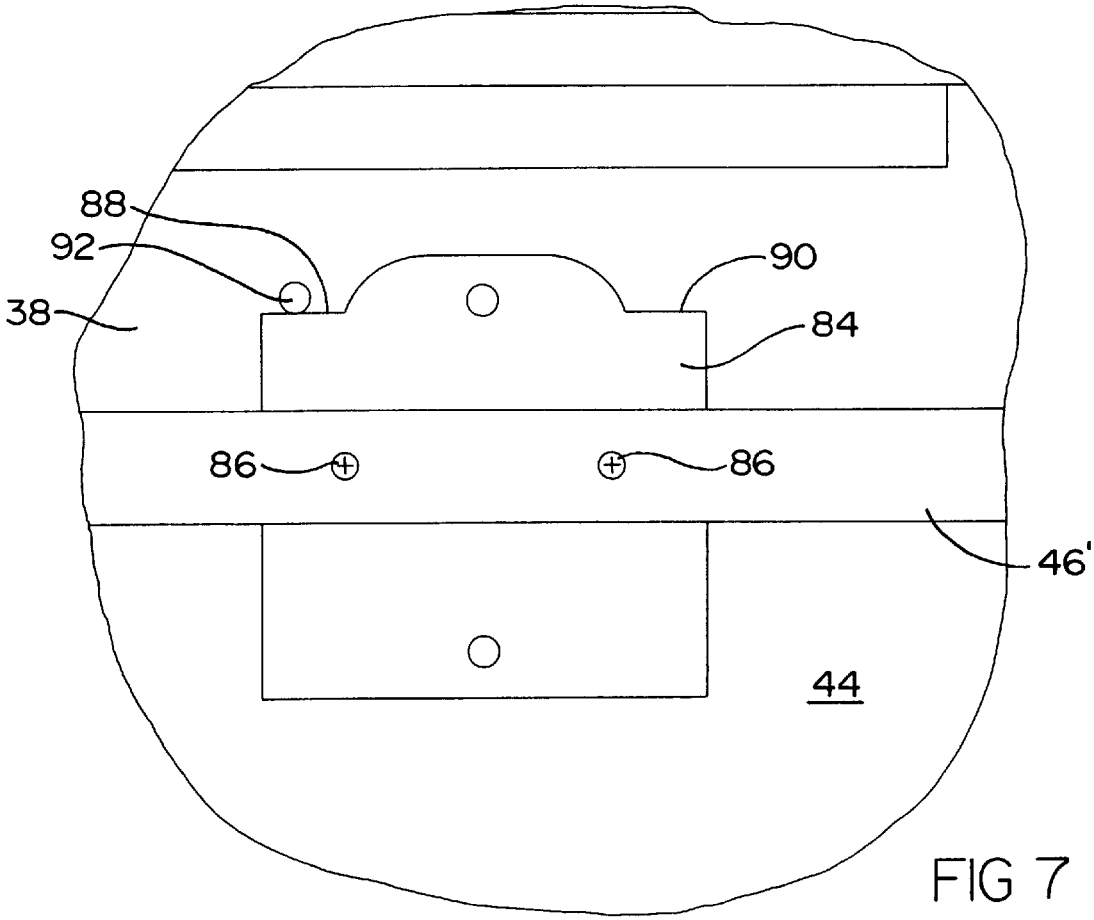
FIG 7

TABLE WITH SELF-STORING LEAF

FIELD OF THE INVENTION

The present invention generally relates to extendable tables and, more particularly, relates to an extendable table having a self-storing leaf that can be rotated about two axis and stowed along the underside of the table surface.

BACKGROUND OF THE INVENTION

As is well known, tables are often provided in a multipiece configuration having two separate, normally coplanar, abutting panels supported by a plurality of legs. These tables frequently have center segments or leaves they can be added or removed when it is desired to increase or decrease the overall size of the tabletop. To this end, a guide mechanism is provided that enables panels to slide apart to form a gap therebetween, which can be filled by one or more table leaves. The table leaf is typically supported between the two panels via support surfaces and associated dowel pins. When it is desired to decrease the size of the tabletop, the two end panels are pulled apart and one or more table leaves are removed. The end panels that form the tabletop are then pushed together to form a smaller tabletop. When it is desired to increase the size of the tabletop, the two end panels are pulled apart again, one or more table leaves are placed between the end panels, and the end panels are pushed back together to form a larger tabletop.

Such prior art extendable tables often suffer from a number of disadvantages. For example, it is typically necessary to store the removed table leaves when not in use. However, this may prove to be difficult in buildings having limited storage space. Moreover, these leaves are often heavy, thereby requiring two people for insertion into or removal from the table. Still further, the handling of the leaves may cause the leaves to be dinged or otherwise marred.

Accordingly, there exists a need in the relevant art to provide an extendable table assembly that is capable of eliminating or at least minimizing the need to lift the full weight of the table leaf. Furthermore, there exists a need in the relevant art to provide an extendable table assembly that includes a table leaf that is easily stowed within the table assembly. Still further, there exists a need in the relevant art to provide an extendable table assembly having at least one table leaf that is capable of being rotated into a stowed position below the tabletop while remaining out of sight from any guests.

SUMMARY OF THE INVENTION

According to the teachings of the present invention, an extendable table including a stowable leaf member is provided having an advantageous construction. The table includes a first table section having a first table surface and a second table section having a second table surface. The second table section is movably coupled to the first table section in a coplanar relationship. A leaf member is further provided and is selectively positionable in an operable position between the first table surface and the second table surface and a stowed position below the table surface. A pivoting assembly couples the leaf member to the first and second table sections and permits the leaf member to rotate about a generally horizontal axis and a generally vertical axis between an operable position and a stowed position. When in this stowed position, the leaf member is generally nestled along the underside of the extendable table surfaces out of sight of a guest.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a partial perspective view of the pivotable leaf assembly of FIG. 1 in an inverted position;

FIG. 4 is a top view of the expandable table assembly of FIG. 1 with the pivotable leaf assembly in an inverted and pivoted position;

FIG. 6 is an end view of a support rod of the expandable table assembly of FIG. 5; and FIG. 7 is a plan view of a swivel bracket and associated cam stops.

DETAILED DESCRIPTION OF THE PREFERRED EMBODIMENTS

Figure 1:
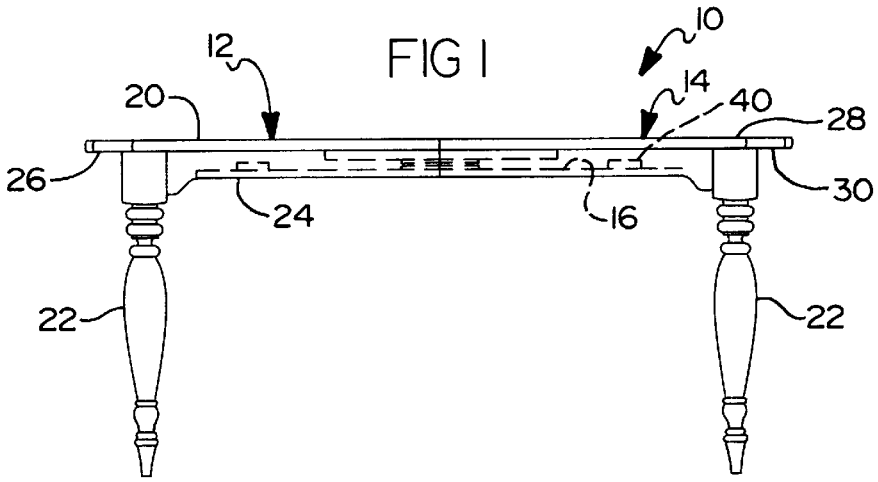
FIG. 1 is a side view of an expandable table assembly according to a first embodiment of the present invention having a pivotable leaf assembly in a stowed position.

The following description of the preferred embodiments is merely exemplary in nature and is in no way intended to limit the invention, its application, or uses.

Referring now to FIGS. 1–4, an expandable table assembly, generally indicated by reference numeral 10, is provided in accordance with a first embodiment of the present invention. Expandable table assembly 10 generally includes a first tabletop panel section 12, a second tabletop panel section 14, a pivotable leaf assembly 16, and a guide mechanism 18.

First tabletop panel section 12 includes a first table panel 20 defining a generally planar tabletop surface, which is mounted to at least one of a plurality of table legs 22 in a conventional manner. It should be appreciated that the specific table illustrated in the attached figures is only exemplary in nature and, thus, should not be interpreted as limiting the present invention. By way of non-limiting example, expandable table assembly 10 may be a pedestal table. First tabletop panel section 12 further includes a decorative skirt 24 coupled along an underside 26 of first table panel 20 generally orthogonal to first table panel 20. Decorative skirt 24 is preferably disposed along the three outboard sides of first tabletop panel section 12.

Second tabletop panel section 14 includes a second table panel 28 defining a generally planar tabletop surface, which is mounted to at least one of the plurality of table legs 22 in a conventional manner. Second table panel 28 is generally coplanar to first table panel 20. Second tabletop panel section 14 further includes decorative skirt 24 coupled along an underside 30 of second table panel 28 generally orthogonal to second table panel 28. Decorative skirt 24 is preferably disposed along the three outboard sides of second tabletop panel section 14.

As best seen in FIG. 3, guide mechanism 18 generally includes a pair of telescoping members 32 each having a first member 34 and a second member 36 slidably coupled with first member 34. First members 34 of the pair of telescoping members 32 are fixedly coupled to underside 26 of first table panel 20 using conventional fasteners. Similarly, second members 36 of the pair of telescoping members 32 are fixedly coupled to underside 30 of second table panel 28 using conventional fasteners. Guide mechanism 18 serves to maintain proper alignment of first tabletop panel section 12 and second tabletop panel section 14 while expanding and retracting table assembly 10. However, it should be noted that the pair of telescoping members 32 should only be disposed on one longitudinal half of expandable table assembly 10 to permit the proper pivoting operation of pivotable leaf assembly 16. However, it should be appreciated that guide mechanism 18 could be any conventional telescoping system, such as that illustrated in connection with the second embodiment of the present invention.

Figure 2:
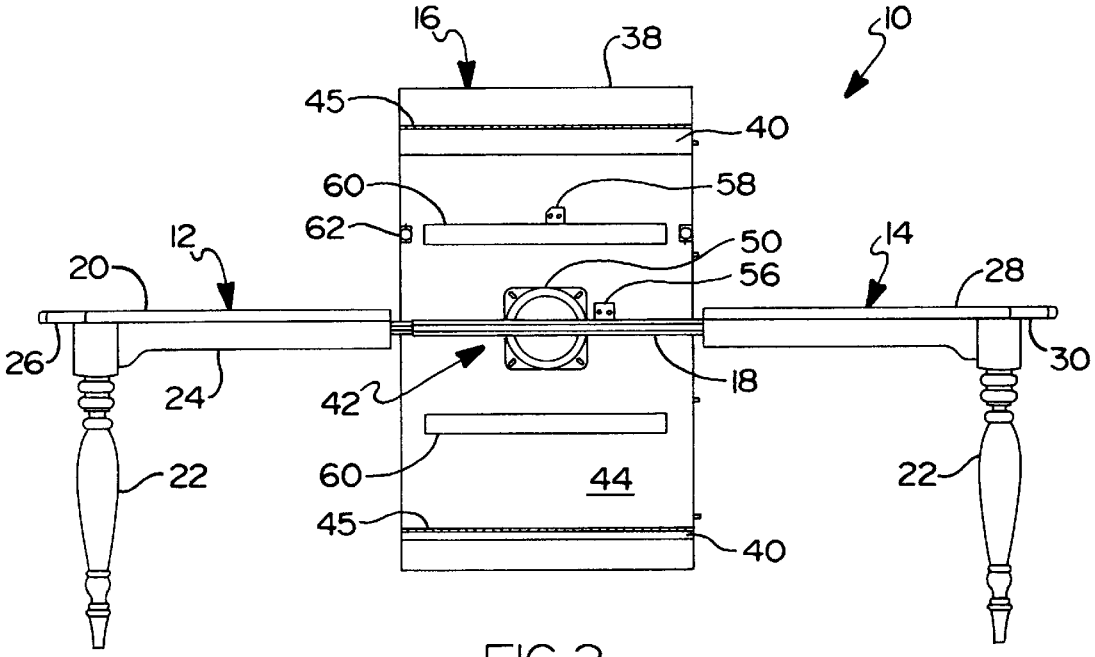
FIG. 2 is a side view of the expandable table assembly of FIG. 1 with the pivotable leaf assembly in an intermediate position.

As best seen in FIGS. 2–4, pivotable leaf assembly 16 generally includes a leaf panel 38, a pair of foldable skirt members 40, and a pivoting mechanism 42. The foldable skirt members 40 are each pivotably coupled to an underside 44 of leaf panel 38 via a hinge member 45. Hinge member 45 may be of any conventional design, such as a piano hinge and the like. Foldable skirt members 40 are positionable between a downwardly extending position and a folded position.

Pivoting mechanism 42 generally includes a support rod 46 slidably and rotatably coupled along underside 26 of first table panel 20 and underside 30 of second table panel 28. However, at the outset, is important to note that pivoting mechanism 42 may have any one of a number of varying configurations. However, according to the present embodiment, support rod 46 is disposed along the longitudinal axis A—A (FIG. 4) of expandable table assembly 10. Pivoting mechanism 42 further includes a sleeve member 48 extending around support rod 46. Sleeve member 48 may be configured such that it permits free pivotable movement about the axis of support rod 46 or is fixed to support rod 46 and rotates together therewith. Each of these options are equally desireable.

A swivel 50 is coupled between sleeve member 48 and underside 44 of leaf panel 38. More particularly, swivel 50 includes a first member 52 that is fixedly coupled to sleeve member 48, such as by welding, and a second member 54 that is fixedly coupled to underside 44 of leaf panel 38 via a plurality of fasteners (not shown). First member 52 is pivotably coupled to second member 54 to permit relative rotation therebetween about an axis B—B. Preferably, a plurality of bearing members (not shown) are disposed in a raceway between first member 52 and second member 54 to provide a smooth pivoting operation.

Pivotable leaf assembly 16 further includes a first pivot stop 56 coupled to underside 44 of leaf panel 38. First pivot stop 56 prevents pivotable movement of leaf panel 38 about axis B—B past a cross-table position (FIG. 3). Similarly, pivotable leaf assembly 16 further includes a second pivot stop 58 coupled to underside 44 of leaf panel 38. Second pivot stop 58 prevents pivotable movement of leaf panel 38 about axis B—B past a stowed position (FIG. 4). In other words, first pivot stop 56 generally provides a user with tactile feedback so as to permit the proper positioning of pivotable leaf assembly 16 within a gap formed between first tabletop panel section 12 and second tabletop panel section 14 (cross-table position). Likewise, second pivot stop 58 generally provides a user with tactile feedback to permit the proper positioning of pivotable leaf assembly 16 for stowage below first table panel 20 and second table panel 28 (stowed position). According to the present embodiment, first pivot stop 56 and second pivot stop 58 are preferably made of wood and fastened to leaf panel 38 using conventional fasteners. However, it is anticipated that first and second pivot stops 56 and 58 may be incorporated directly into the structure of pivoting mechanism 42, such as through a pin and cam assembly.

Pivotable leaf assembly 16 still further includes a pair of optional support braces 60 mounted on underside 44 of leaf panel 38. Support braces 60 are adapted to provide additional structural reinforcement to leaf panel 38 and further minimize warpage, which may occur when using natural materials such as wood. However, it should be appreciated that support braces 60, while being preferred, are optional and thus can be eliminated.

Furthermore, pivotable leaf assembly 16 includes a plurality of locking members 62 that are adapted to engage respective locking members (not shown) disposed along underside 26 of first tabletop panel section 12 and underside 30 of second tabletop panel section 14. The plurality of locking members 62 minimizes inadvertent separation of first tabletop panel section 12 and second tabletop panel section 14.

Lastly, it should be appreciated that pivotable leaf assembly 16 further includes a plurality of dowel pins 64 disposed along a side thereof. The plurality of dowel pins 64 is intended to engage a plurality of corresponding bores 66 formed in second table panel 28 to aid in the rigidity and alignment of expandable table assembly 10. Similarly, first table panel 20 further includes a plurality of dowel pins 68 disposed along a side thereof. The plurality of dowel pins 68 is intended to engage a plurality of corresponding bores 70 formed in leaf panel 38 when the table is in an expanded position or, alternatively, to engage the plurality of bores 66 formed in second table panel 28 when the table is in a retracted position.

The operation of expandable table assembly 10 will now be described in detail. Specifically, in order to convert expandable table assembly 10 from an expanded position (large tabletop surface) to a retracted position (small tabletop surface), first tabletop panel section 12 and second tabletop panel section 14 are pulled apart such that the plurality of dowel pins 64 and 68 become disengaged from the corresponding bores 66 and 70, respectively, thereby freeing pivotable leaf assembly 16 from first tabletop panel section 12 and second tabletop panel section 14 for rotation about an axis C—C extending through support rod 46. As best seen in FIGS. 2 and 3, pivotable leaf assembly 16 is then pivoted about axis C—C approximately 180 degrees until underside 44 of leaf panel 38 faces upward (i.e. inverted cross-table position). Foldable skirt members 40 are then pivoted into a down position about hinge member 45 (as illustrated by skirt member 40*a* of FIG. 3). In this position, foldable skirt members 40 are nestled against leaf panel 38 to minimize the drop height (the distance between leaf panel 38 and underside 26 and 30 of first table panel 20 and second table panel 28, respectively) necessary for stowage. By minimizing the drop height of pivotable leaf assembly 16, pivotable leaf assembly 16 may be stowed closely to first table panel 20 and second table panel 28 to minimize the likelihood of pivotable leaf assembly 16 being viewable from the side when in the stowed position or interfering with the legs of users of the table when they are seated up to it. This will be further discussed below.

Once pivotable leaf assembly 16 is in the inverted cross-table position (FIG. 3) and foldable skirt members 40 are pivoted into a down position, pivotable leaf assembly 16 is then pivoted approximately 90 degrees about axis B—B via swivel 50 until the longitudinal axis of leaf panel 38 is generally parallel to support rod 46 and second pivot stop 58 generally contacts sleeve member 48 of pivoting mechanism 42 (FIG. 4). First tabletop panel section 12 and second tabletop panel section 14 are then pushed together until the plurality of dowel pins 68 of first tabletop panel section 12 are received within the corresponding bores 66 of second tabletop panel section 14. In order to convert expandable table assembly from a retracted position to an expanded position, the above operation is reversed.

Figure 5:
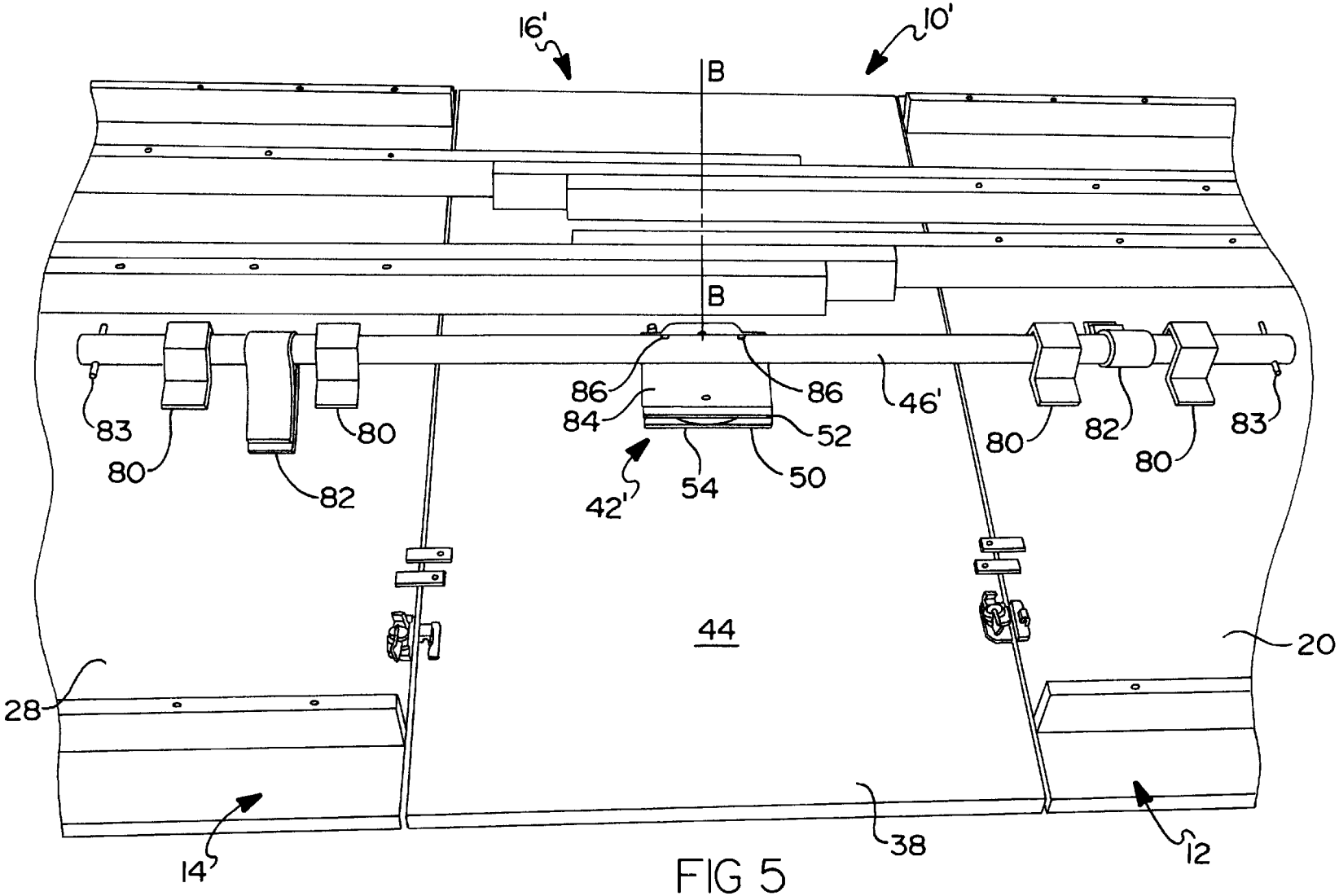
FIG. 5 is a bottom perspective view of an expandable table assembly according to a second embodiment of the present invention having a pivotable leaf in an operational position.

With particular reference to FIGS. 5–7, an expandable table assembly, generally indicated by reference numeral 10', is provided in accordance with a second embodiment of the present invention. Expandable table assembly 10' is similar to expandable table assembly 10 and, thus, like reference numerals are to be regarded as like or corresponding members among the several views. In the interest of brevity, those like or corresponding members will not be discussed in detail in reference to the present embodiment.

With particular reference to FIG. 5, expandable table assembly 10' generally includes a pivotable leaf assembly 16' having leaf panel 38 and a pivoting mechanism 42'. As should be appreciated in the present embodiment, the pair of foldable skirt members 40 of the first embodiment had been removed. However, it should be understood that the pair of foldable skirt members 40 may also be included in the present embodiment if desired.

Pivoting mechanism 42' generally includes a support rod 46' slidably and rotatably coupled between underside 26 of first table panel 20 and underside 30 of second table panel 28 via a plurality of generally U-shaped support brackets 80. According to the present embodiment, support rod 46' is disposed along the longitudinal axis A—A of expandable table assembly 10' and is retained by the plurality of generally U-shaped support brackets 80 upon opposing ends thereof. Support brackets 80 are adapted to support the weight of pivotable leaf assembly 16'. However, it should be readily appreciated that the specific number of rectangular support brackets 80 required depends upon the materials used in both support rod 46' and leaf panel 38 and the associated likelihood of bending and/or warping.

Still referring to FIG. 5, pivoting mechanism 42' further includes a pair of tether straps 82 surrounding opposing ends of support rod 46'. The pair of tether straps 82 are wrapped around support rod 46' and fastened to underside 26 of first table panel 20 and underside 30 of second table panel 28 via conventional fasteners. The pair of tether straps 82 are made of a friction imparting material, such as nylon webbing, leather, or any other material that is capable of frictionally engaging support rod 46' to minimize the free rotation of leaf panel 38 and support rod 46'. It should be appreciated that the plurality of support brackets 80 and the pair of tether straps 82 may be combined into a single member to minimize the number of parts required, such as a support bracket that is appropriately sized to create a friction fit between the brackets and support rod.

Still referring to FIGS. 5 and 6, support rod 46' further includes a pair of dowel members 83 extending orthogonally through opposing ends thereof to prevent the inadvertent disengagement of support rod 46' from the plurality of support brackets 80. That is, as first tabletop panel section 12 and second tabletop panel section 14 are pulled apart, the pair of dowel members 83 are adapted to prevent excessive separation of first tabletop panel section 12 and second tabletop panel section 14, thereby eliminating the possibility of support rod 46' being pulled out of any one of the plurality of support brackets 80.

Swivel 50 serves to permit relative, generally horizontal, swivel motion between leaf panel 38 and support rod 46' about axis B—B. More particularly, swivel 50 includes first member 52 that is fixedly coupled to a swivel bracket 84. Swivel bracket 84 is in turn fixedly coupled to support rod 46' via a plurality of fasteners 86. Additionally, swivel 50 further includes second member 54 that is fixedly coupled to underside 44 of leaf panel 38 via a plurality of fasteners (not shown). First member 52 is pivotably coupled to second member 54 to permit relative rotation therebetween about axis B—B. Preferably, a plurality of bearing members (not shown) are disposed in a raceway between first member 52 and second member 54 to provide a smooth pivoting operation.

As best seen in FIG. 7, swivel bracket 84 further include a first cam stop 88 and a second cam stop 90 formed thereon. First cam stop 88 and second cam stop 90 are adapted to function in concert with a stop member 92 extending from underside 44 of leaf panel 38. Stop member 92 engages first cam stop 88 or second cam stop 90 to prevent excessive rotational movement of leaf panel 38 about axis B—B. More particularly, stop member 92 is adaped to engage first cam stop 88 (FIG. 7) when leaf panel 38 is in either the operational cross-table position (FIG. 5) or the inverted cross-table position (FIG. 3). Similarly, stop member 92 is adapted to engage second cam stop 90 when leaf panel 38 is in the stowed position (FIG. 4). First cam stop 88 and second cam stop 90 are positioned so as to permit generally 90 degrees of rotation about axis B—B.

Operation of expandable table assembly 10' is similar to that described in connection with expandable table assembly 10. However, in order to convert expandable table assembly 10' from an expanded position (large tabletop surface) to a retracted position (small tabletop surface), first tabletop panel section 12 and second tabletop panel section 14 are pulled apart such that the plurality of dowel pins 64 and 68 become disengaged from the corresponding bores 66 and 70, respectively, thereby freeing pivotable leaf assembly 16' from first tabletop panel section 12 and second tabletop panel section 14 for rotation about axis C—C. Pivotable leaf assembly 16' is then pivoted about axic C—C approximately 180 degrees until underside 44 of leaf panel 38 faces upward (i.e. inverted cross-table position). As best seen in FIG. 6, support rod 46' includes a generally flattened section 94 formed on a side thereof that is adapted to rest on a corresponding flat section 96 formed on support brackets 80. This arrangement generally prevents support rod 46' and, thus, leaf panel 38, from rotating out of the inverted position, thereby remaining generally horizontal under the tabletop during stowage. This is particularly useful to minimize the possibility of pivotable leaf assembly 16' being viewed from the side by a guest.

Once pivotable leaf assembly 16' has been pivoted about axis C—C and is in the inverted cross-table position, pivotable leaf assembly 16' is then pivoted approximately 90 degrees about axis B—B via swivel 50 until the longitudinal axis of leaf panel 38 is generally parallel to support rod 46 and stop member 92 contacts second cam stop 90. First tabletop panel section 12 and second tabletop panel section 14 are then pushed together until the plurality of dowel pins 68 of first tabletop panel section 12 are received within the corresponding bores 66 of second tabletop panel section 14. In order to convert expandable table assembly from a retracted position to an expanded position, the above operation is reversed.

It should be appreciated that the expandable table assembly of the present invention provides a number of advantages over prior art expandable table designs. For example, as a result of the foldable skirt members 40 being positionable in a nestled position, the pivotable leaf assembly 16 is stowed at a drop height distance below first table panel 20 and second table panel 28 that is less than the height of each foldable skirt member 40. This is particularly useful in that it improves the aesthetic quality of the expandable table assembly and further provides improved spacing between a user's knees and the pivotable leaf assembly. Furthermore, the expandable table assembly of the present invention further eliminates the need to lift and remove an otherwise heavy and/or awkward tabletop leaf as is required in many prior art designs.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An extendable table comprising:

a first table section having a first table surface;

a second table section having a second table surface, said second table section being movably coupled to said first table section such that said second table surface and said first table surface are generally coplanar, said first table section and said second table section being positionable in an extended position where said first table surface is spaced apart from said second table surface and a retracted position where said first table surface abuts said second table surface;

a leaf member selectively positionable in an operable position between said first table surface and said second table surface and a stowed position below said first table surface and said second table surface; and a pivoting assembly coupling said leaf member to said first table section and said second table section, said pivoting assembly being operable to permit said leaf member to rotate about a generally vertical axis and a generally horizontal axis between said operable position and said stowed position, said pivoting assembly having a support rod extending longitudinally between said first table section and said second table section, said support rod defining said generally horizontal axis, said pivoting assembly further having a pivot mechanism coupled between said support rod and said leaf member, said pivot mechanism operable to permit said leaf member to pivot about said generally horizontal axis into an inverted position, said pivot mechanism further operable to permit said leaf member to pivot about said generally vertical axis into said stowed position, wherein said leaf member is generally hidden from view from a user when in said stowed position.

2. The expandable table according to claim 1 wherein said pivot mechanism comprises:

a sleeve slidably disposed about said support rod to permit rotation about said generally horizontal axis; and a swivel coupled between said sleeve and said leaf member to permit rotation about said generally vertical axis.

3. The expandable table according to claim 1 wherein said pivot mechanism comprises:

a swivel bracket coupled to said support rod; and a swivel coupled between said swivel bracket and said leaf member to permit rotation about said generally vertical axis, wherein said support rod is rotatable about said horizontal axis.

4. The expandable table according to claim 3, further comprising:

a stop member extending from said leaf member; and at least one cam stop formed in said swivel bracket, said at least one cam stop engagable with said stop member to prevent further rotation of said leaf member about said generally vertical axis.

5. The expandable table according to claim 1, further comprising:

a plurality of support brackets coupled separately to said first table section and said second table section, each of said plurality of support brackets having a generally flat section; and a flat surface formed on said support rod, said flat surface positionable against said generally flat section of each of said plurality of support brackets to generally inhibit rotation of said leaf member.

6. The expandable table according to claim 5, further comprising:

at least one dowel member extend orthogonally through an end of said support rod, said at least one dowel member engagable with at least one of said plurality of support brackets to prevent the inadvertent disengagement of said support rod from said plurality of support brackets.

7. The expandable table according to claim 1, further comprising:

a pair of stop members coupled to said leaf member, said pair of stop members being operable to limit rotation of said leaf member about said generally vertical axis.

8. An extendable table comprising:

a first table section having a first table surface;

a second table section having a second table surface, said second table section being movably coupled to said first table section such that said second table surface and said first table surface are generally coplanar, said first table section and said second table section being positionable in an extended position where said first table surface is spaced apart from said second table surface and a retracted position where said first table surface abuts said second table surface;

a leaf member selectively positionable in an operable position between said first table surface and said second table surface and a stowed position below said first table surface and said second table surface;

at least one skirt member hingedly coupled to said leaf member, said at least one skirt member being positionable in an operable vertical position and a stowed horizontal position to minimize a drop height required between said leaf member and said first table surface and said second table surface; and a pivoting assembly coupling said leaf member to said first table section and said second table section, said pivoting assembly being operable to permit said leaf member to rotate about a generally vertical axis and a generally horizontal axis between said operable position and said stowed position, said pivoting assembly having a support rod extending longitudinally between said first table section and said second table section, said support rod defining said generally horizontal axis, said pivoting assembly further having a pivot mechanism coupled between said support rod and said leaf member, said pivot mechanism operable to permit said leaf member to pivot about said generally horizontal axis into an inverted position, said pivot mechanism further operable to permit said leaf member to pivot about said generally vertical axis into said stowed position.

9. The expandable table according to claim 8 wherein said pivot mechanism comprises:

a sleeve slidably disposed about said support rod to permit rotation only about said generally horizontal axis; and a swivel coupled between said sleeve and said leaf member to permit rotation only about said generally vertical axis.

10. The expandable table according to claim 8 wherein said pivot mechanism comprises:

a swivel bracket coupled to said support rod; and a swivel coupled between said swivel bracket and said leaf member to permit rotation about said generally vertical axis, wherein said support rod is rotatable about said horizontal axis.

11. The expandable table according to claim 10, further comprising:

a stop member extending from said leaf member; and at least one cam stop formed in said swivel bracket, said at least one cam stop engagable with said stop member to prevent further rotation of said leaf member about said generally vertical axis.

12. The expandable table according to claim 8, further comprising:

a plurality of support brackets coupled separately to said first table section and said second table section, each of said plurality of support brackets having a generally flat section; and a flat surface formed on said support rod, said flat surface positionable against said generally flat section of each of said plurality of support brackets to generally inhibit rotation of said leaf member.

13. The expandable table according to claim 8, further comprising:

at least one dowel member extend orthogonally through an end of said support rod, said at least one dowel member engagable with at least one of said plurality of support brackets to prevent the inadvertent disengagement of said support rod from said plurality of support brackets.

14. The expandable table according to claim 8, further comprising:

a pair of stop members coupled to said leaf member, said pair of stop members being operable to limit rotation of said leaf member about said generally vertical axis.

15. An extendable table comprising:

a first table section having a first table surface;

a second table section having a second table surface, said second table section being movably coupled to said first table section such that said second table surface and said first table surface are generally coplanar, said first table section and said second table section being positionable in an extended position where said first table surface is spaced apart from said second table surface and a retracted position where said first table surface abuts said second table surface;

a leaf member selectively positionable in an operable position between said first table surface and said second table surface and a stowed position below said first table surface and said second table surface;

a support rod extending longitudinally between said first table section and said second table section, said support rod defining a generally horizontal axis;

a sleeve slidably disposed about said support rod to permit rotation only about said generally horizontal axis, said sleeve operable to permit said leaf member to pivot about said generally horizontal axis into an inverted position; and a swivel coupled between said sleeve and said leaf member to permit rotation only about said generally vertical axis, said swivel operable to permit said leaf member to pivot about a generally vertical axis into a stowed position.

16. The expandable table according to claim 15, further comprising:

at least one skirt member hingedly coupled to said leaf member, said at least one skirt member being positionable in an operable vertical position and a stowed horizontal position to minimize a drop height required between said leaf member and said first table surface and said second table surface.

17. The expandable table according to claim 15, further comprising:

a first pair of stop members coupled to said leaf member, said first pair of stop members being operable to limit rotation of said leaf member about said generally vertical axis.

18. The expandable table according to claim 17, further comprising:

a second pair of stop members coupled to said leaf member, said second pair of stop members being operable to limit rotation of said leaf member about said generally horizontal axis.

19. The expandable table according to claim 15 wherein said pivot mechanism comprises:

a swivel bracket coupled between said swivel and said support rod;

a stop member extending from said leaf member; and at least one cam stop formed in said swivel bracket, said at least one cam stop engagable with said stop member to prevent further rotation of said leaf member about said generally vertical axis.

20. The expandable table according to claim 15, further comprising:

a plurality of support brackets coupled separately to said first table section and said second table section, each of said plurality of support brackets having a generally flat section; and a flat surface formed on said support rod, said flat surface positionable against said generally flat section of each of said plurality of support brackets to generally inhibit rotation of said leaf member.

* * * * *